US010038272B2

(12) United States Patent
DeBlois et al.

(10) Patent No.: US 10,038,272 B2
(45) Date of Patent: Jul. 31, 2018

(54) FLEXIBLE ELECTRICAL POWER STRIP

(71) Applicant: Western New England University, Springfield, MA (US)

(72) Inventors: Asa G. DeBlois, Shelton, CT (US); Jeremy Christopher Downs, Falls Village, CT (US); Brooke Martin Kumnick, Granby, CT (US); Paul D. Lisborg, Rochester, NY (US); Jonathan Clifford Schultz, Wilton, NH (US); Richard B. Mindek, Willington, CT (US); Robert T. Gettens, Longmeadow, MA (US); Mary G. Schoonmaker, Longmeadow, MA (US); Glenn E. Vallee, Westbrook, CT (US)

(73) Assignee: WESTERN NEW ENGLAND UNIVERSITY, Springfield, MA (US)

( * ) Notice: Subject to any disclaimer, the term of this patent is extended or adjusted under 35 U.S.C. 154(b) by 0 days.

(21) Appl. No.: 15/687,949

(22) Filed: Aug. 28, 2017

(65) Prior Publication Data

US 2018/0062302 A1 Mar. 1, 2018

Related U.S. Application Data

(60) Provisional application No. 62/381,099, filed on Aug. 30, 2016.

(51) Int. Cl.
*H01R 31/02* (2006.01)
*H01R 27/02* (2006.01)
(Continued)

(52) U.S. Cl.
CPC ..... *H01R 13/514* (2013.01); *H01R 25/003* (2013.01); *H01R 27/02* (2013.01)

(58) Field of Classification Search
CPC ..... H01R 31/02; H01R 31/06; H01R 27/02; H01R 35/04; H01R 25/006; H01R 25/003
(Continued)

(56) References Cited

U.S. PATENT DOCUMENTS 2,267,816 A * 12/1941 Chirelstein ..... H01R 31/02 439/601
2,299,617 A * 10/1942 Eisenberg, Jr. ..... H01R 31/02 439/652
(Continued)

OTHER PUBLICATIONS

YOUMO—Your Smart Modular Power Strip by Good Gadgets—Kickstarter retreived from: https://www.kickstarter.com/projects/1300499319/youmo-your-smart-modular-power-strip 2017.

*Primary Examiner* — Gary Paumen
(74) *Attorney, Agent, or Firm* — Cantor Colburn LLP

(57) ABSTRACT

An electrical power strip that may be flexibly configured is provided. The power strip includes a power cord having a plug configured to operably couple with a wall socket. A head block is electrically coupled to the power cord on an end opposite the first plug. The head block having a first outlet socket on one end configured to receive a first external power plug. The head block further includes a first, second and third female electrical connector located on different sides. A power block having a first male connector on a side is electrically coupled with one of the first, second or third female connector. The first power block having a second outlet socket configured to receive a second external power plug. The power block further having a fourth, fifth and sixth female connectors located on different sides.

20 Claims, 10 Drawing Sheets

(51) Int. Cl.
*H01R 35/04* (2006.01)
*H01R 13/514* (2006.01)
*H01R 25/00* (2006.01)

(58) Field of Classification Search
USPC ..... 439/652, 651, 535, 8
See application file for complete search history.

(56) References Cited

U.S. PATENT DOCUMENTS 2,318,484 A * 5/1943 Herman ..... H01R 31/00 439/601
D194,105 S * 11/1962 More ..... D13/137.2
3,997,225 A * 12/1976 Horwinski ..... H01R 13/648 439/105
4,918,258 A * 4/1990 Ayer ..... H02G 3/00 174/53
5,593,316 A * 1/1997 Lyons ..... H01R 13/72 439/501
5,658,152 A * 8/1997 Selker ..... H01R 35/04 439/31
5,658,158 A * 8/1997 Milan ..... H01R 13/514 439/214
5,735,710 A * 4/1998 Blaauboer ..... H01R 9/2458 439/535
6,443,772 B1 * 9/2002 Chen ..... H01R 25/003 200/51.02
7,497,740 B2 * 3/2009 Mei ..... H01R 13/514 200/51 R
8,262,399 B1 * 9/2012 Zien ..... H01R 25/003 439/188
9,525,252 B2 * 12/2016 Kim ..... H01R 25/003
D795,812 S * 8/2017 Huang ..... D13/139.6
2003/0176100 A1 * 9/2003 Yurek ..... H01R 27/00 439/535
2008/0088995 A1 * 4/2008 Yang ..... H01R 13/6675 361/78
2010/0277892 A1 * 11/2010 Konopelko ..... H01R 13/6658 362/95
2011/0086542 A1 * 4/2011 Chow ..... H01R 13/514 439/540.1
2011/0287665 A1 * 11/2011 Chien ..... F21S 8/035 439/638
2012/0028505 A1 * 2/2012 Weber ..... H01R 25/003 439/638
2014/0036421 A1 * 2/2014 Leiba ..... H01R 13/20 361/679.01
2015/0001937 A1 * 1/2015 Wang ..... H01R 13/70 307/52
2015/0270664 A1 * 9/2015 Noriega ..... H01R 25/003 439/502

* cited by examiner

FLEXIBLE ELECTRICAL POWER STRIP

CROSS-REFERENCE TO RELATED APPLICATIONS

The present invention is a nonprovisional application of U.S. Provisional Application Ser. No. 62/382,099 filed on Aug. 30, 2016, the contents of which are incorporated by reference in their entirety.

BACKGROUND

The subject matter disclosed herein relates to an electrical power strip, and in particular to an electrical power strip that has a configurable shape.

Users of electrical devices are often confronted with the issue of an overcrowded power strip. With the outlets close together, devices with large or oddly shaped chargers will often cover more than one outlet in a conventional power strip. As shown in FIG. 1, it is common to see a power strip with six standard outlets that only has the ability to fit two or three plugs. To avoid this situation the user has two options. They can buy additional power strips to fit all their plugs or only plug in a select few plugs at a time.

The first option is not only wasteful, but also requires the consumer to spend money on an extra power strip or connector that they should not have needed in the first place. Also, having several power strips in one location is not very aesthetically pleasing, and chaining them together may result in an electrical overloading of one or more of the power strips. The second option may not be viable for a number of individuals because they need multiple plugs in at the same time. If this is not the case, removing and replacing plugs is very annoying and a waste of time.

Accordingly, while existing power strips are suitable for their intended purposes the need for improvement remains, particularly in providing a power strip that is configurable to allow different size plugs to fit in adjacent receptacles.

BRIEF DESCRIPTION

According to one aspect of the disclosure an electrical power strip is provided. The power strip includes a power cord having a plug configured to operably couple with a wall socket. A head block is electrically coupled to the power cord on an end opposite the first plug. The head block having a first outlet socket on one end configured to receive a first external power plug. The head block further including a first female electrical connector on a first side, a second female electrical connector on a second side and a third female electrical connector on a third side. A power block having a first male connector on a side is electrically coupled with one of the first female electrical connector, the second female electrical connector and the third female connector. The first power block having a second outlet socket configured to receive a second external power plug. The power block further having a fourth female connector on a first side, a fifth female connector on a second side and a sixth female connector on a third side.

According to another aspect of the disclosure, an electrical power distribution system is provided. An electrical power distribution system including a power cord having a plug configured to operably couple with a wall socket. A head block is electrically coupled to the power cord on an end opposite the plug, the head block having a first plurality of female connectors, each of the first plurality of female connectors being disposed on a different side. A first power block having first outlet socket is configured to couple with a first external power plug. The first power block has a second plurality of female connectors, each of the second plurality of female connectors being disposed on a different side, the first power block further having a first male connector configured to couple with the first plurality of female connector. A second power block having a second outlet socket is configured to couple with a second external power plug. The second power block has a third plurality of female connectors, each of the third plurality of female connectors being disposed on a different side. The second power block further having a second male connector configured to couple with the first plurality of female connectors and the second plurality of female connectors, the second power block being electrically coupled to the first power block.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

Figure 1:
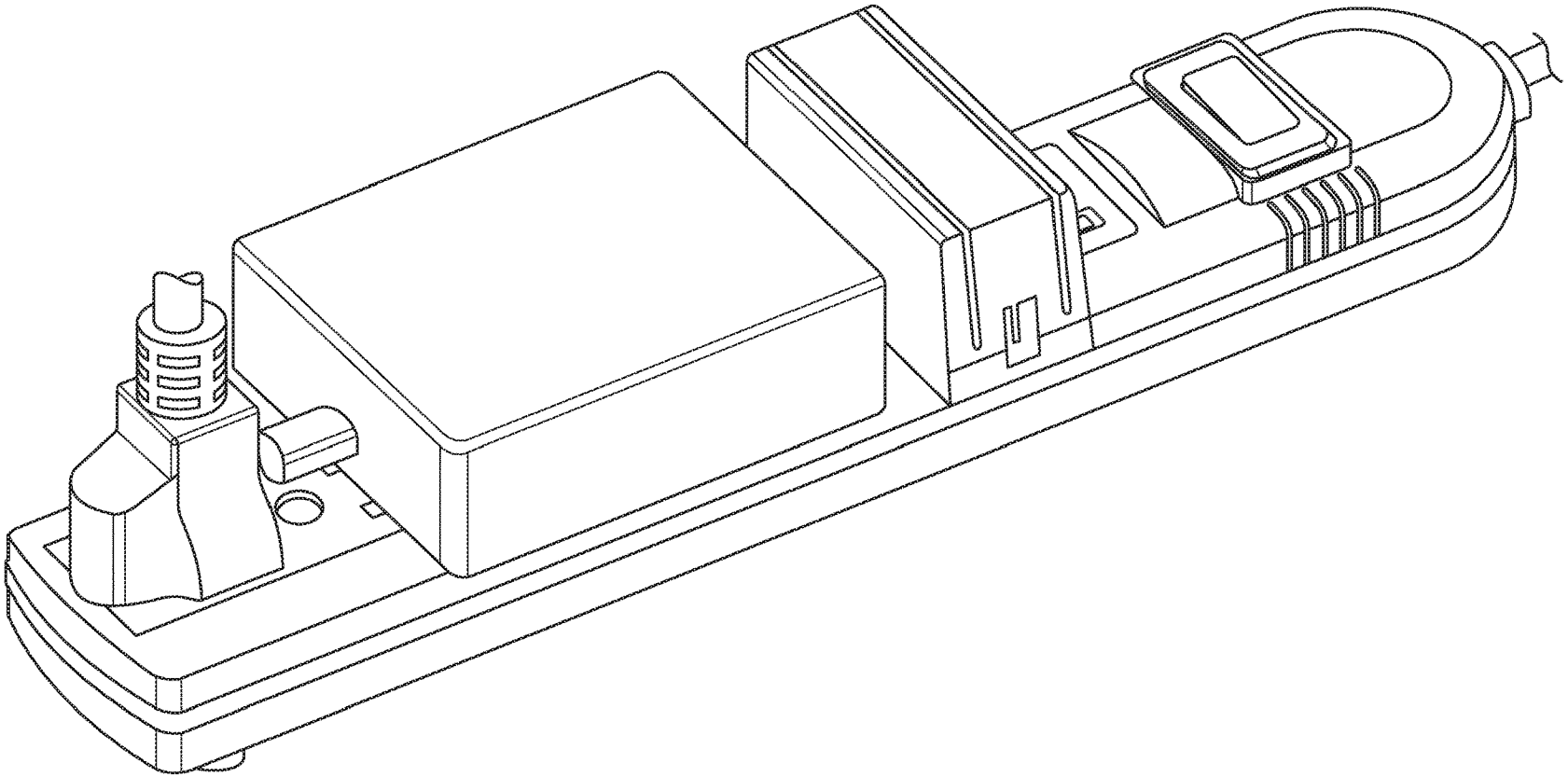
FIG. 1 (Prior Art)
FIG. 1 is an perspective view of a prior art electrical power strip.
Figure 2:
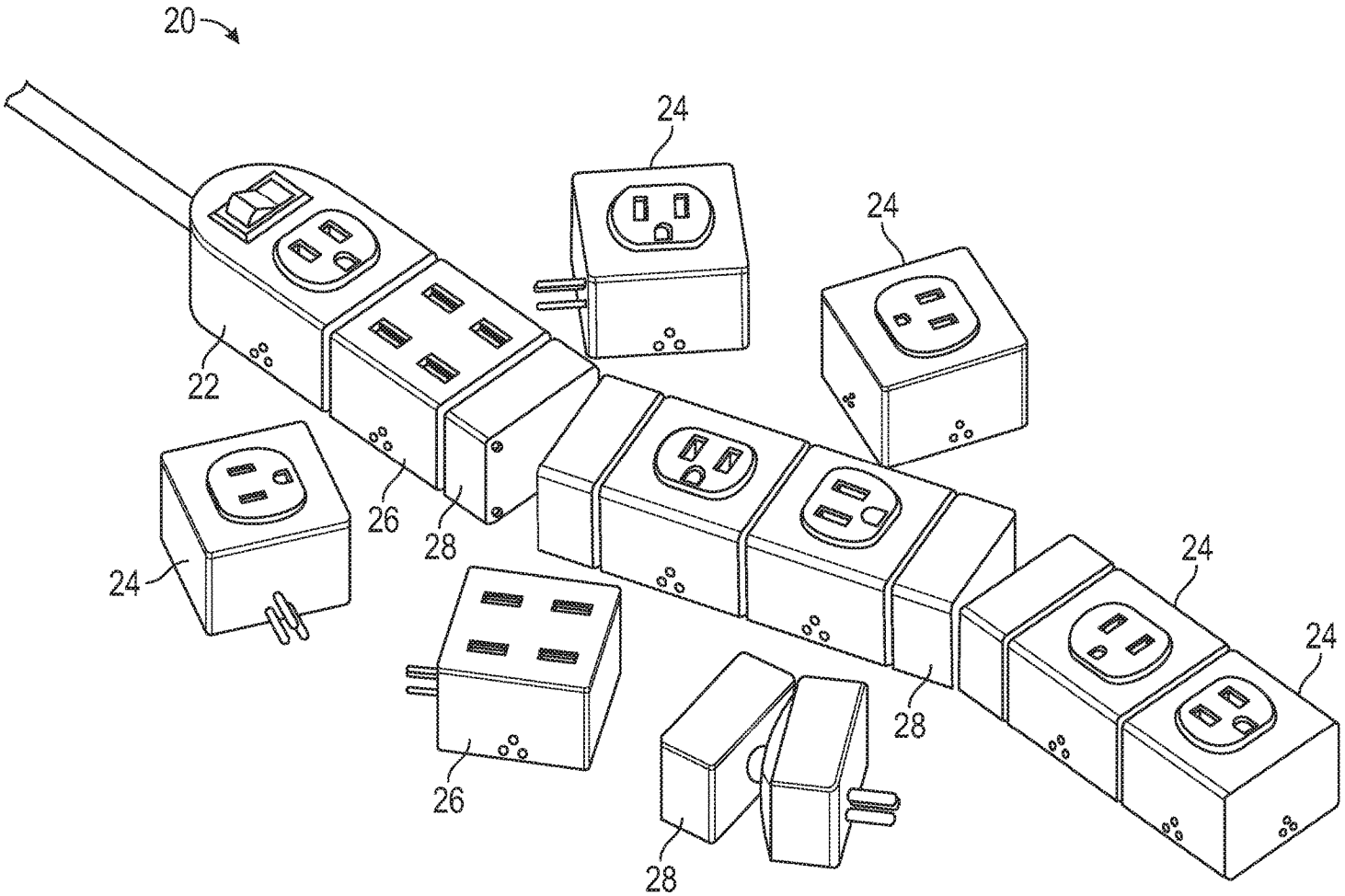
FIG. 2 is a perspective view of a configurable electrical power strip or electrical power distribution system in accordance with an embodiment.
Figure 3:
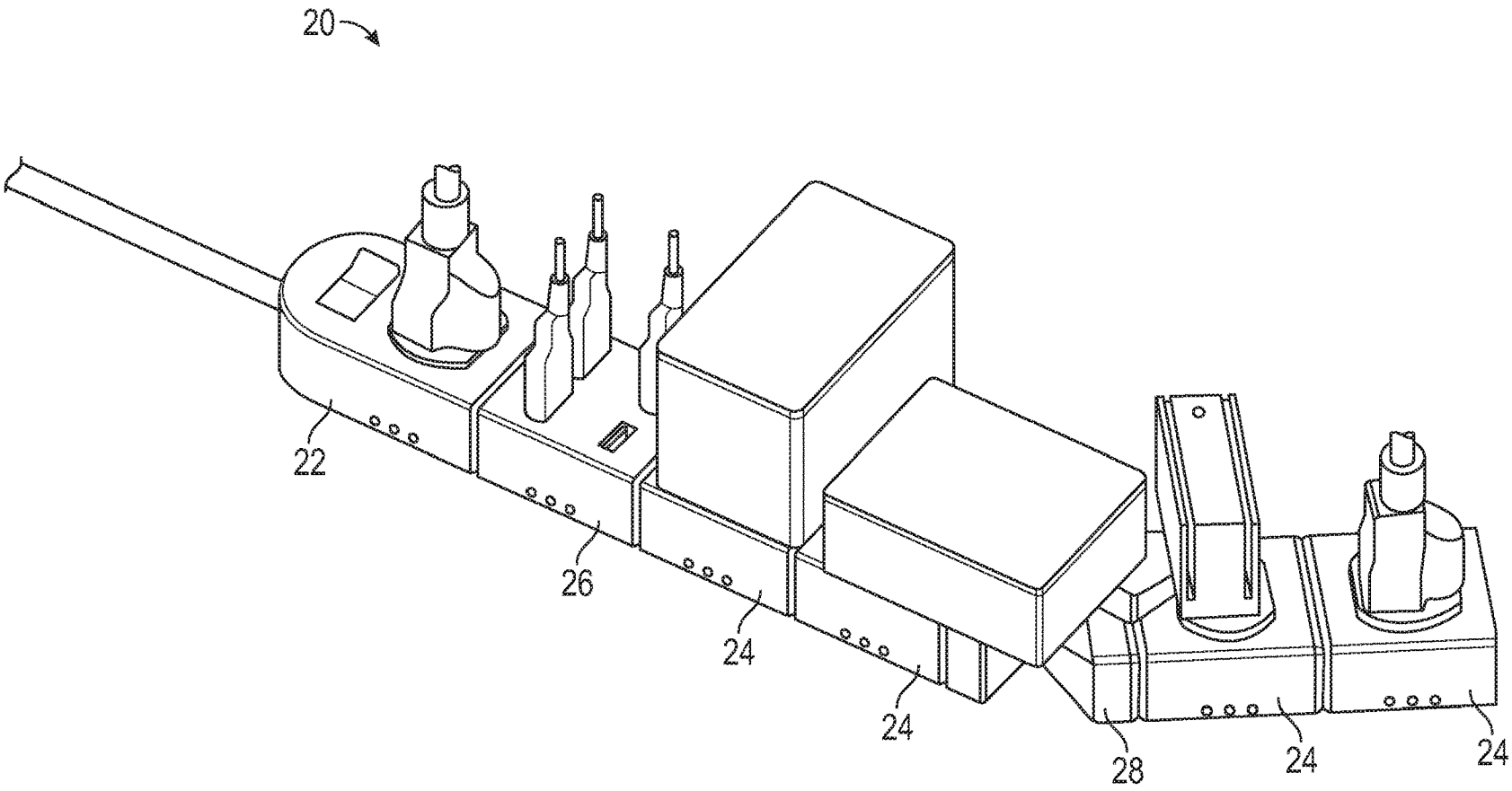
FIG. 3 is a perspective view of the configurable electrical power strip of FIG. 2 with external electrical plugs installed.

The detailed description explains embodiments of the disclosure, together with advantages and features, by way of example with reference to the drawings.

DETAILED DESCRIPTION

Embodiments of the present invention provide for a modular power strip that is simple, easy to use, customizable, and flexible. Embodiments of the invention provide for a power strip features interlocking blocks, which fit together into any configuration that the user desires. Each block can fit into any position on the power strip, and gives the user almost unlimited options to create a power strip to fit their needs. Embodiments of the present invention provide for a plug design between the blocks, to reduce or eliminate the risk of shock from plugging the individual blocks into a wall outlet. Embodiments provide advantages in that the process of plugging the blocks into each other becomes intuitive. In an embodiment, a switch with a fuse is also provided to limit the amount of power traveling through the strip to a predetermined current, such as 15 amps for example. In an embodiment, within each block module, the outlet sockets for external plugs can rotate through a full 360 degrees, giving the user the ability to fit bulky and inconvenient plugs and charger cords. Embodiments of the present invention further provide for a power strip having a six foot long power cord, with a 45-degree angled plug, to make it usable at nearly any place in a room.

Embodiments of the present invention provide for a modular arrangement to the power strip, with many different block modules being removably interchangeable to fit the desired external plugs. The design features a head block module, which has an outlet socket, an on-off fused switch, and is coupled to a six foot wall cord. In some embodiments, the power strip includes a head block module to connect to the wall, causing all electrical power to the power strip to pass through a fuse. On the sides of the head block module are three sets of three female connectors, which the power passes through. In an embodiment, a standard power block module features one rotating outlet socket, and three more sets of three female connectors. It also has one set of three male pins which plug into an adjacent block module to get electrical power. By having only one set of male pins on each block module, the connector pins will not be exposed when electricity is flowing to them. In an embodiment, another block module is the USB block module, containing four USB ports and is configured to fit with any female connector on the power strip, while also using the same male connector arrangement as the standard block. Finally, in an embodiment, there is a rotating block module, containing a ball and socket joint. The rotating block module gives the user the ability to rotate the power strip along its longitudinal axis, or turn it about 30 degrees in any direction. In an embodiment, electrical conductors pass through a small hole in the ball joint, using stranded wire to give it the ability to flex.

In an embodiment, the block modules work via soldered wire connections between the pins at the bottom of the blocks. These pins then connect to a unit containing a rotating plug, with contactors pressing on the rotating unit to maintain pressure, and pass electricity to the plug. The electrical power received from the male connectors is passed to any plug inserted into the outlet socket on the module and to any female connectors. The USB block module also contains a circuit board to step down the power to the voltage and amperage required by a cell phone charger. In an embodiment, each block is molded as a top portion, with a bottom cap that is attached via screws after the internals are installed inside.

Figure 4:
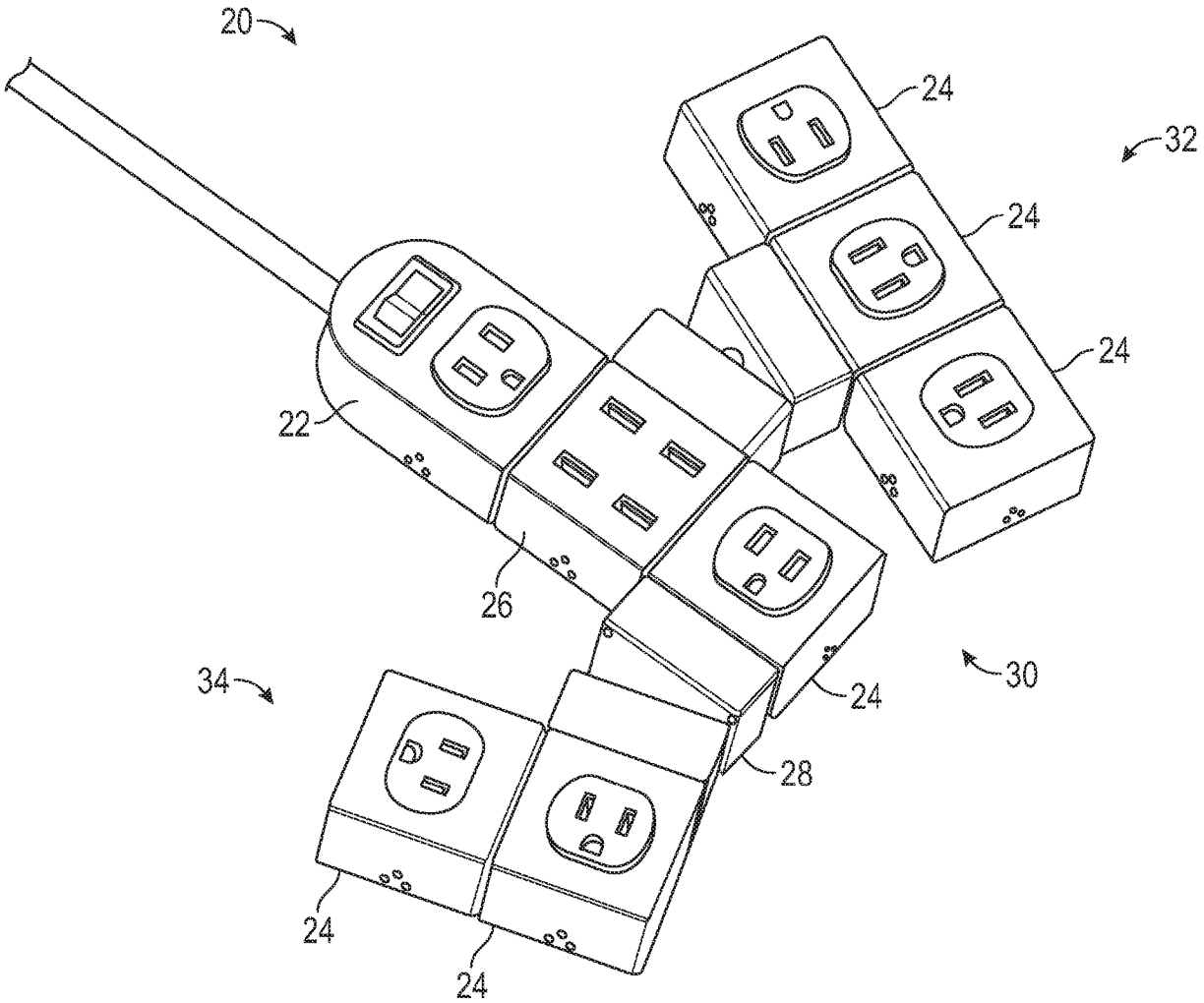
FIG. 4 is a perspective view of the configurable electrical power strip of FIG. 2 in accordance with another embodiment.
Figure 5:
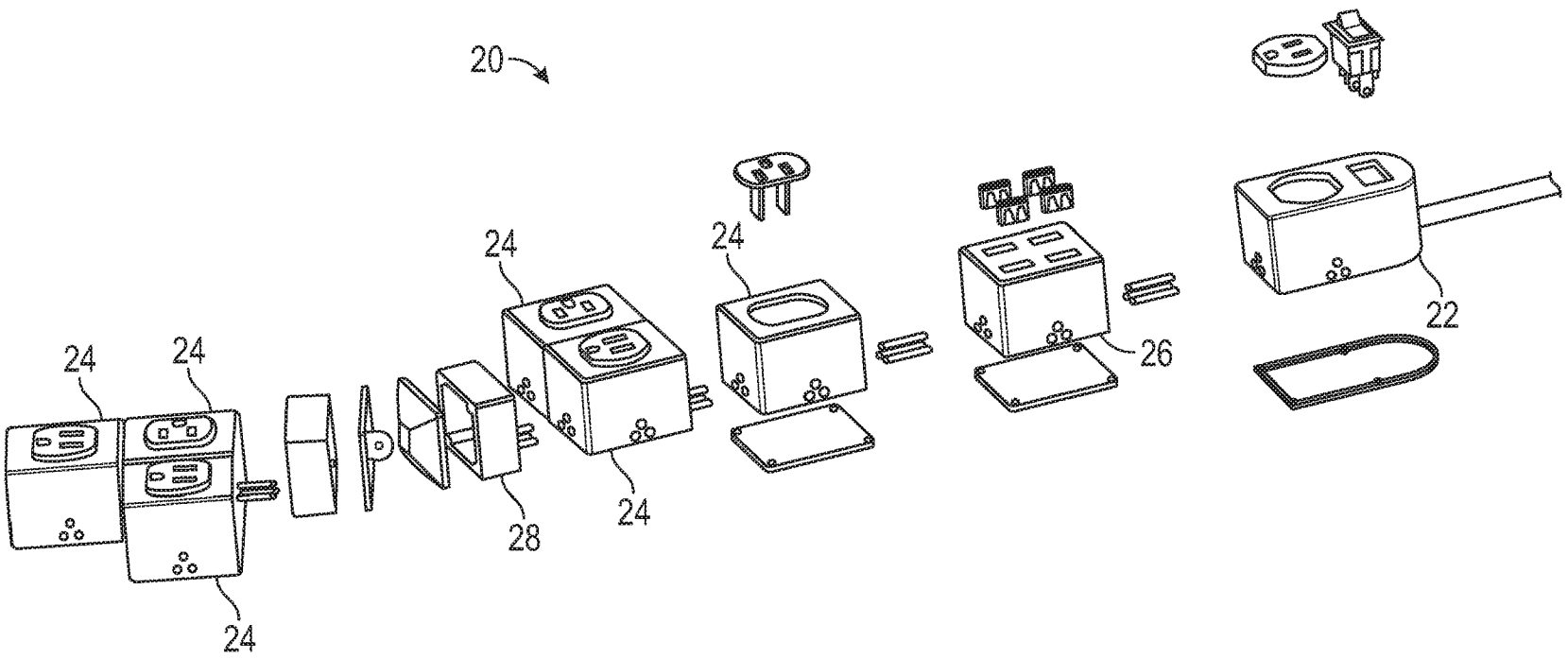
FIG. 5 is an exploded view of the electrical power strip of FIG. 2 in accordance with an embodiment.
Figure 6:
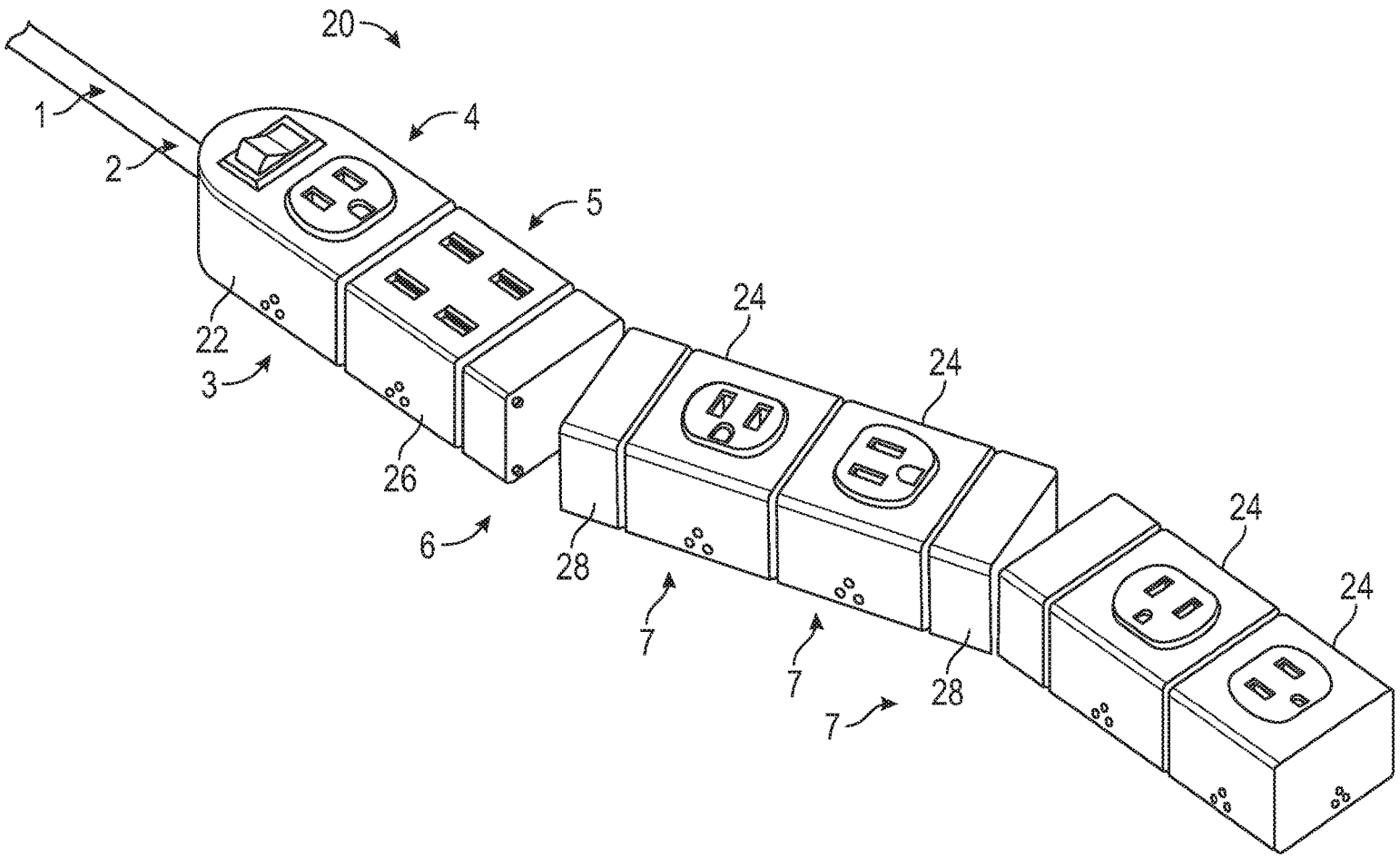
FIG. 6 is a perspective view of the electrical power strip of FIG. 2 in accordance with an embodiment.

Referring now to FIGS. 2-6 embodiments of the modular power strip system 20 are shown in different configurations. In an embodiment, each of the power strips 20 may include a head block module 22, a power block module 24 a USB block module 26 and a rotation block module 28. The block modules each have female connectors on three sides allowing adjacent block modules to be connected on each of the three sides. In the embodiment of FIG. 2, FIG. 3, FIG. 5 and FIG. 6, the modules 22, 24, 26, 28 of power strip 20 are arranged in series (e.g. each module is connected to the female connector of the preceding module that is located opposite the male pins). In the embodiment of FIG. 4, the power strip 20 includes a center portion 30, with a first branch portion 32 and a second branch portion 34. The branch portions 32, 34 are arranged on either side of the center portion 30 and each are connected to the center portion by a rotation block module 28.

Figure 7A:
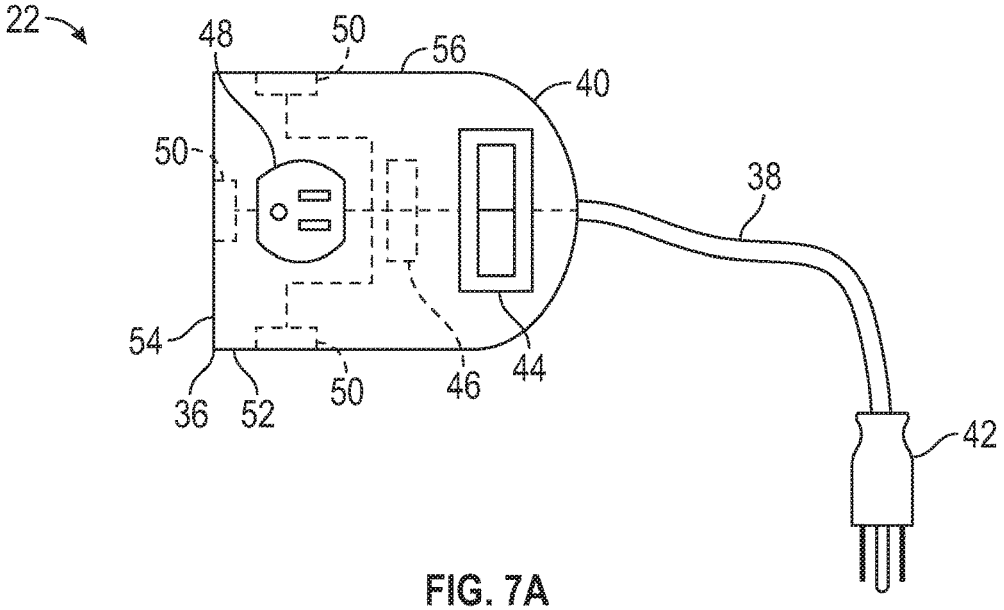
FIG. 7A, FIG. 7B and FIG. 7C are views of a head block module for use with the electrical power strip of FIG. 2 in accordance with an embodiment.
Figure 7B:
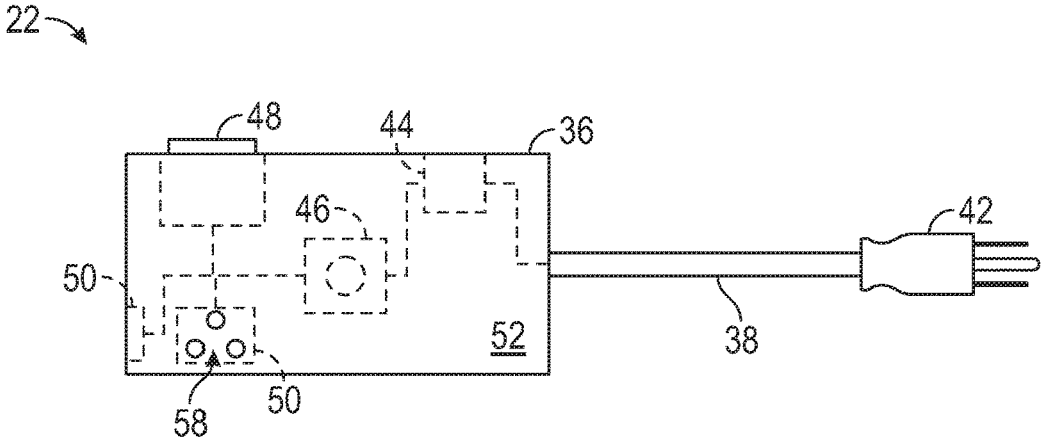
Figure 7C:
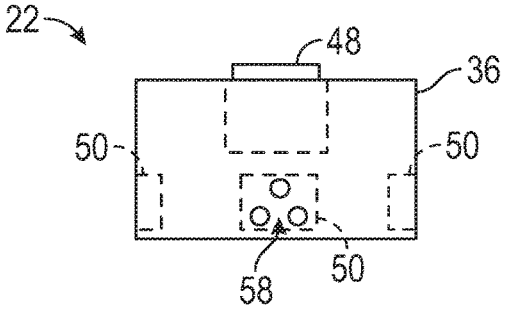

Referring now to FIG. 7A, FIG. 7B and FIG. 7C, an embodiment is shown of the head block module 22. In this embodiment, the head block module 22 includes a housing 36 with a power cord 38 extending from one side 40. The power cord 38 includes a plug 42 on an opposite end. In the exemplary embodiment, the plug 42 is configured to couple to a standard wall electrical outlet to flow electrical power from the wall outlet through the plug 42 and power cord 38 to the housing 36. In an embodiment, the head block module 22 includes a switch 44 that is electrically coupled to the power cord 38. The switch 44 is configured to start and stop the flow of electrical power to modules downstream from the switch 44 in response to actuation by a user.

A fuse member 46 is electrically coupled to the switch 44 opposite the power cord 38. The fuse member 46 provides protection against over-current conditions that may occur if the electrical devices connected to the power strip 20 draw electrical current above a predetermined threshold. In an embodiment, the fuse member 46 is a resettable device (e.g. a circuit breaker). The head block module 22 further includes an outlet socket 48. The outlet socket 48 is configured to receive an electrical plug from an external electrical device and provide electrical power thereto. In an embodiment, the outlet socket 48 is compliant with the NEMA 5-15 (Type B) standard or the IEC 60906-2 standard. It should be appreciated that in other embodiments, the outlet socket 48 may comply with other standards without deviating from the disclosed embodiments. The outlet socket 48 is electrically coupled to the fuse member 46 and receives electrical power therefrom. In an embodiment, the outlet socket 48 is configured to rotate about an axis extending substantially perpendicular to the front plane of the outlet socket 48. This allows the user to change the orientation of the outlet socket 48 to accommodate the size and shape of the electrical plug for the external device, or an electrical plug connected to an adjacent outlet socket.

The fuse member 46 is further electrically connected to a plurality of female electrical connectors 50. The female electrical connectors 50 are each disposed on a side 52, 54, 56 of the housing 36. As will be discussed in more detail herein, the arrangement of the female electrical connectors 50 on different sides of the housing 36 allows the user to configure the power strip 20 in different shapes. In an embodiment, the female electrical connectors 50 each include three receptacles 58 that are arranged in a geometric configuration to (e.g. a triangular arrangement) and sized to receive pins from a male connector of an adjacent module.

Figure 8A:
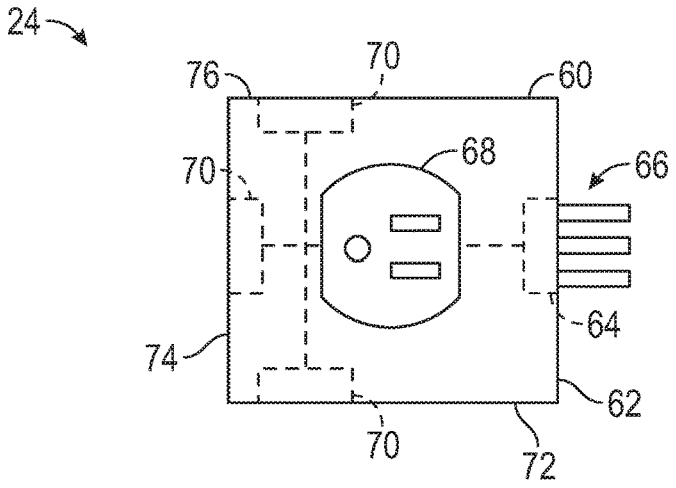
FIG. 8A, FIG. 8B and FIG. 8C are views of a power block module for use with the electrical power strip of FIG. 2 in accordance with an embodiment.
Figure 8B:
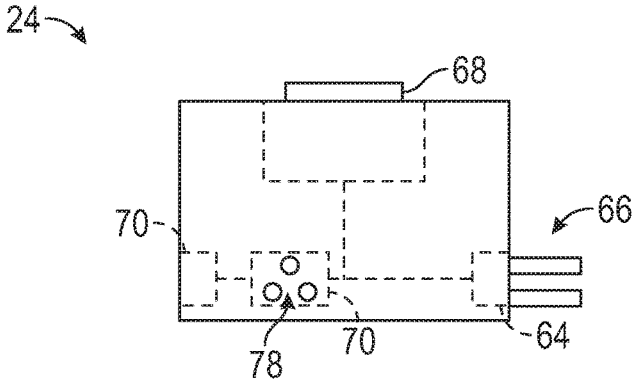
Figure 8C:
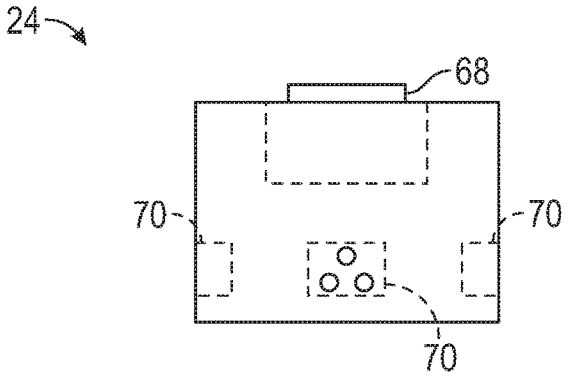

Referring now to FIG. 8A, FIG. 8B and FIG. 8C, an embodiment is shown of a power block module 24. The power block module 24 includes a housing 60. In an embodiment, the power block module 24 has a generally parallelepiped shape. On a first side 62 of housing 60, the power block module 24 includes a male electrical connector 64. In an embodiment, the male electrical connector 64 includes a plurality of pins 66 (e.g. three) that are arranged and sized to be received in the receptacles 58 such that electrical power from the female electrical connector will flow into the power block module 24.

Electrically coupled to the male electrical connector 64 is an outlet socket 68 arranged on a top surface of the power block module 24. In an embodiment, the outlet socket 68 is a NEMA 5-15 (Type B) outlet. In another embodiment, the outlet socket 68 may be rotated about an axis extended substantially perpendicular to a front plane of the outlet socket. The power block module 24 further includes a plurality of female electrical connectors 70. In an embodiment, the female electrical connectors 70 are configured identically to the female electrical connectors 50 of the head block module 22. The female electrical connectors 70 are each arranged on a different side 72, 74, 76 of housing 60. The female electrical connectors 70 each include receptacles 78 sized and arranged to receive pins from a male connector of an adjacent module. It should be appreciated that the male electrical connector 64, outlet socket 68 and female electrical connectors 70 are all electrically connected such that any electrical power received via pins 66 will flow to the outlet socket 68 and the female electrical connectors 70. It should be appreciated that having a single male electrical connector 64 provides advantages in avoiding the exposure of electrically charged conductors when the power strip is functioning.

Figure 9A:
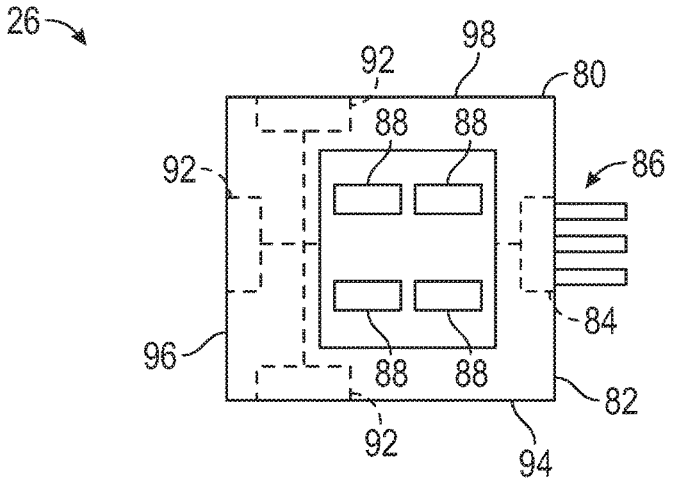
FIG. 9A, FIG. 9B and FIG. 9C are views of a USB block module for use with the electrical power strip of FIG. 2 in accordance with an embodiment.
Figure 9B:
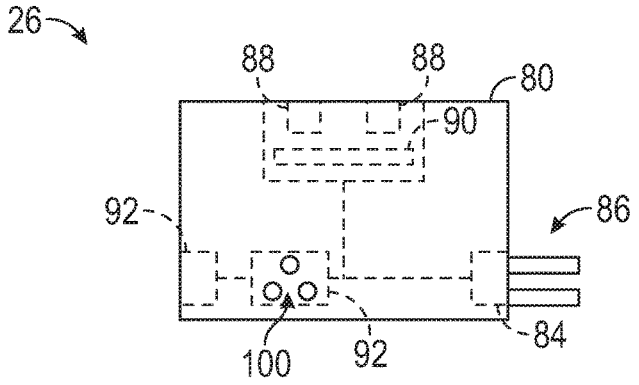
Figure 9C:
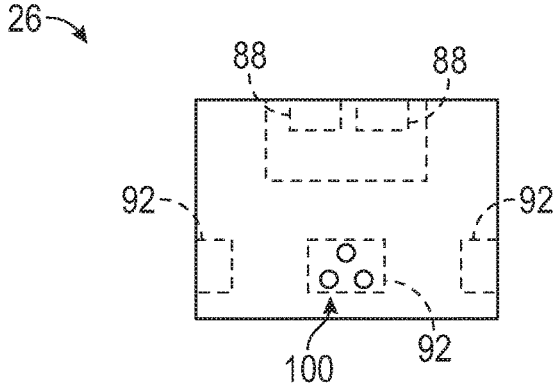

Referring now to FIG. 9A, FIG. 9B and FIG. 9C, an embodiment is shown of the USB block module 26. The USB block module 26 is similar to the power block module 24 in that it has a housing 80. In an embodiment, the housing 80 may have a parallelepiped shape. On a first side 82 of housing 80, the USB block module 26 includes a male electrical connector 84. In an embodiment, the male electrical connector 84 includes a plurality of pins 86 (e.g. three) that are arranged and sized to be received in the receptacles 58, 78 such that electrical power from the female electrical connector will flow into the USB block module 26.

Electrically coupled to the male electrical connector 64 are one or more Universal Serial Bus (USB) sockets 88 arranged on a top surface of the USB block module 26. In an embodiment, the USB sockets 88 are compliant with the IEC 62680 standard. In an embodiment, the USB block module 26 includes a power converter 90 that is electrically coupled between the male electrical connector 84 and the USB sockets 88. The power converter 90 converts to input electrical power (e.g. 120VAC) to have a power characteristic compatible with the USB sockets 88 (e.g. 5VDC).

The USB block module 26 further includes a plurality of female electrical connectors 92. In an embodiment, the female electrical connectors 92 are configured identically to the female electrical connectors 50 of the head block module 22. The female electrical connectors 92 are each arranged on a different side 94, 96, 98 of housing 80. The female electrical connectors 92 each include receptacles 100 sized and arranged to receive pins from a male connector of an adjacent module. It should be appreciated that the male electrical connector 84, the USB sockets 88 and female electrical connectors 92 are all electrically connected such that any electrical power received via pins 66 will flow to the USB sockets 88 and the female electrical connectors 92.

Figure 10A:
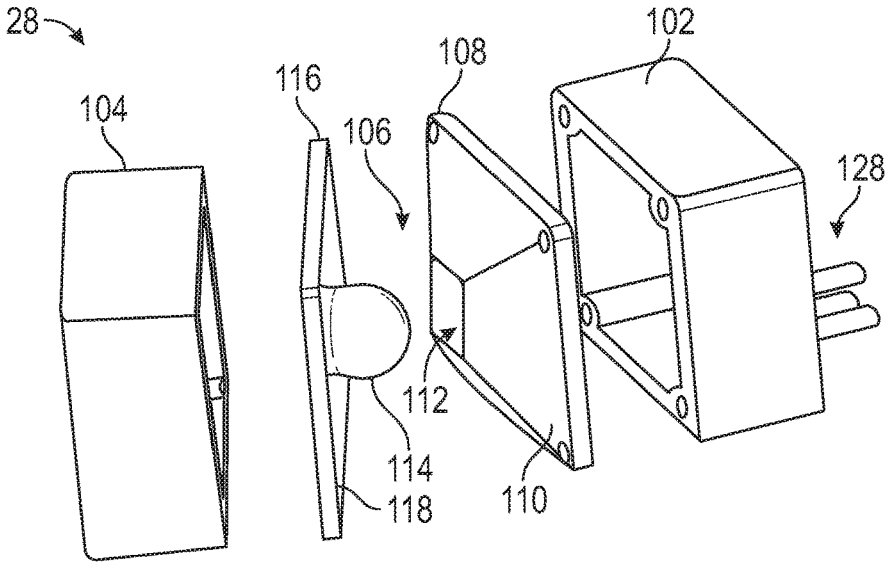
FIG. 10A, FIG. 10B and FIG. 10C are views of a rotation block module for use with the electrical power strip of FIG. 2 in accordance with an embodiment.
Figure 10B:
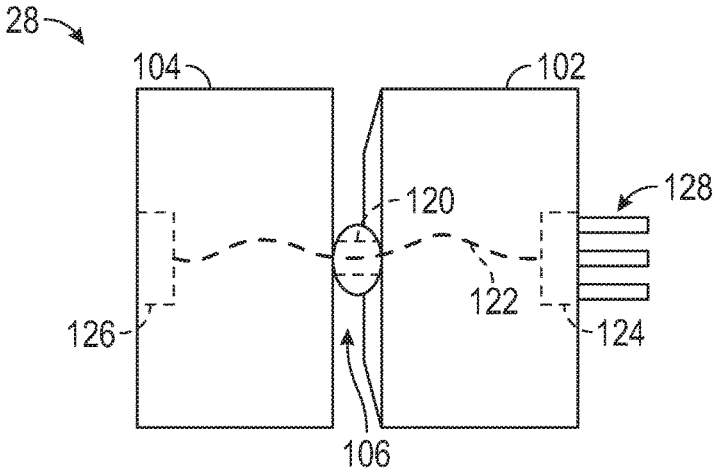
Figure 10C:
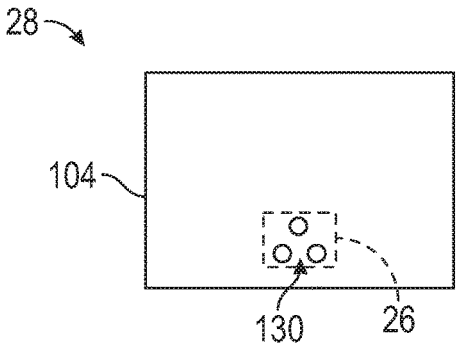

Referring now to FIG. 10A, FIG. 10B and FIG. 10C, an embodiment is shown of a rotation block module 28. In the exemplary embodiment, the rotation block module 28 is different than the power block module 24 and the USB block module 26 in that it does not have any electrical power outlets for external devices. Rather, the rotation block module 28 allows the user to reorient or pivot the direction of the electrical power strip 20. It should be appreciated that in other embodiments, the rotation block module 28 may also include sockets, such as an outlet socket or a USB socket for example.

The rotation block module 28 includes a first housing 102 and a second housing 104 that are coupled together by a ball and socket joint 106. In an embodiment, the first housing 102 includes an end cover 108 having a square frustum shaped surface 110. Centrally located on the surface 110 is a socket 112. The socket 112 is sized to receive a ball member 114. The ball member 114 extends from a cover member 116 attached to the second housing 104. When the ball member 114 is inserted into the socket 112, the housings 102, 104 may rotate relative to each other. The amount of rotation is defined by the square frustum shaped surface 110 and a surface 118 of the cover 116. The housings 102, 104 may be rotated in any direction until the surface 118 contacts and stops against the surface 110. In the exemplary embodiment, the first housing 102 and the second housing 104 may rotate about 30 degrees relative to each other.

In an embodiment, the ball and socket joint 106 includes an opening 120 that extends therethrough. The opening is sized to receive a conductor 122 that extends between a male electrical connector 124 and a female electrical connector 126. The opening 120 and conductor 122 are sized to allow conductor 122 pass through the opening 120 without interfering with the rotation of the housings 102, 104. The male electrical connector 124 includes a plurality of pins 128 (e.g. three) that are arranged and sized to be received in the receptacles 58, 78, 100 such that electrical power from the female electrical connector will flow into the conductor 122. The female electrical connector 126 is configured identically to the female electrical connectors 50 of the head block module 22. The female electrical connector 126 is arranged on a side opposite the male electrical connector 124. The female electrical connector 126 includes receptacles 130 sized and arranged to receive pins from a male connector of an adjacent module.

It should be appreciated while embodiments herein describe particular block modules having particular sockets, the claimed invention should not be so limited. In other embodiments, other types of electrical output connections may be incorporated into block modules to allow use of the output connection with the power strip 20. For example, the power block module may include an outlet socket that is compliant with a CEE 7/3 socket or a BS 546 socket for example. Further, other types of electrical connections may be provided, such as by incorporating a power supply for the external electrical device into the block module to allow direct powering of the external electrical device without the need for an inline power supply (sometimes colloquially referred to as a "brick").

Further, it should be appreciated that the block modules 24, 26, 28 are fully interchangeable and do not need to be arranged in any particular order.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A power strip comprising:

a power cord having a plug configured to operably couple with a wall socket;

a head block electrically coupled to the power cord on an end opposite the plug, the head block having a first outlet socket on one end configured to receive a first external power plug, the head block includes a first female electrical connector on a first side, a second female electrical connector on a second side and a third female electrical connector on a third side; and a first power block having a first male connector on a side configured to electrically couple with one of the first female electrical connector, the second female electrical connector and the third female electrical connector, the first power block having a second outlet socket configured to receive a second external power plug, the first power block further having a fourth female connector on a first side, a fifth female connector on a second side and a sixth female connector on a third side.

2. The power strip of claim 1 further comprising a USB block having a plurality of receptacles on one end, the plurality of receptacles each being configured to receive a Universal Serial Port plug, the USB block further having a seventh female connector on a first side, an eighth female connector on a second side and a ninth female connector on a third side, the USB block further having a second male connector on one end, the second male connector configured to couple with one of the first female electrical connector, the second female electrical connector, the third female electrical connector, the fourth female connector, the fifth female connector and the sixth female connector.

3. The power strip of claim 2 further comprising a rotation block having a first housing and a second housing pivotally coupled by a ball joint, the ball joint having a hole passing there through between the first housing and the second housing, the first housing having a third male connector and the second housing having the seventh female connector, the third male connector being configured to couple with one of the first female electrical connector, the second female electrical connector, the third female electrical connector, the fourth female connector, the fifth female connector, the sixth female connector, the seventh female connector, the eighth female connector and the ninth female connector.

4. The power strip of claim 3 wherein the rotation block further includes an electrical conductor coupled between the third male connector and the seventh female connector, the electrical conductor extending through the hole.

5. The power strip of claim 2 wherein at least one of the first outlet socket and the second outlet socket are configured to rotate about an axis.

6. The power strip of claim 3 wherein the rotation block is electrically coupled between the head block and the first power block.

7. The power strip of claim 3 wherein the rotation block is electrically coupled between the first power block and the USB block.

8. The power strip of claim 2 wherein the USB block is electrically coupled between the head block and the first power block.

9. The power strip of claim 1 wherein the head block further includes a switch electrically coupled between the power cord and the first outlet socket.

10. An electrical power distribution system comprising:

a power cord having a plug configured to operably couple with a wall socket;

a head block electrically coupled to the power cord on an end opposite the plug, the head block having a first plurality of female connectors, each of the first plurality of female connectors being disposed on a different side;

a first power block having first outlet socket configured to couple with a first external power plug, the first power block having a second plurality of female connectors, each of the second plurality of female connectors being disposed on a different side, the first power block further having a first male connector configured to couple with the first plurality of female connectors; and a second power block having a second outlet socket configured to couple with a second external power plug, the second power block having a third plurality of female connectors, each of the third plurality of female connectors being disposed on a different side, the second power block further having a second male connector configured to couple with the first plurality of female connectors and the second plurality of female connectors, the second power block being electrically coupled to the first power block.

11. The electrical power distribution system of claim 10 further comprising a rotation block having a first housing and a second housing pivotally coupled by a ball joint, the ball joint having a hole passing therethrough between the first housing and the second housing, the first housing having a third male connector and the second housing having female connector, the third male connector being configured to electrically couple to the first plurality of female connectors, the second plurality of female connectors and the third plurality of female connectors, the rotation block being electrically coupled to the first power block, the second power block and the head block.

12. The electrical power distribution system of claim 11 wherein the rotation block is electrically coupled between the head block and the first power block.

13. The electrical power distribution system of claim 11 wherein the rotation block is electrically coupled between the first power block and the second power block.

14. The electrical power distribution system of claim 10 wherein the first power block is coupled to a first female connector of the first plurality of female connectors and the second power block is coupled to a second female connector of the first plurality of female connectors.

15. The electrical power distribution system of claim 10 further comprising a USB block having a plurality of receptacles on one end, the plurality of receptacles each being configured to receive a Universal Serial Port plug, the USB block further having a fourth male connector and a fourth plurality of female connectors, each of the fourth plurality of female connectors being on a different side, the USB block being electrically coupled to the head block, the first power block and the second power block.

16. The electrical power distribution system of claim 15 wherein the USB block is electrically coupled between the head block and the first power block.

17. The electrical power distribution system of claim 15 wherein the USB block is electrically coupled between the first power block and the second power block.

18. The electrical power distribution system of claim 15 wherein the USB block is pivotally coupled to one of the head block, the first power block or the second power block.

19. The electrical power distribution system of claim 10 wherein:

each of the first plurality of female connectors includes a first opening a second opening and a third opening arranged in a geometric configuration; and the first male connector includes a first pin, a second pin and a third pin arranged in the geometric configuration.

20. The electrical power distribution system of claim 10 wherein:

the first outlet socket rotates about a first axis; and the second outlet socket rotates about a second axis, the first axis and the second axis are parallel.

* * * * *